US006828532B2

(12) United States Patent
Han et al.

(10) Patent No.: US 6,828,532 B2
(45) Date of Patent: Dec. 7, 2004

(54) MICROWAVE OVEN WITH MICROWAVE LEAK CONTROL

(75) Inventors: Dae-Sung Han, Hwasung (KR); Yong-Woon Han, Kunpo (KR); Seong-Deog Jang, Suwon (KR); Joo-Yong Yeo, Suwon (KR); Han-Seong Kang, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 80 days.

(21) Appl. No.: 10/347,626

(22) Filed: Jan. 22, 2003

(65) Prior Publication Data

US 2004/0050843 A1 Mar. 18, 2004

(30) Foreign Application Priority Data

Sep. 14, 2002 (KR) ..... 2002-55989

(51) Int. Cl.[7] ..... H05B 6/68

(52) U.S. Cl. ..... 219/722; 219/724; 126/197; 200/50.02

(58) Field of Search ..... 219/722–724, 219/738, 739; 126/197; 200/50.02, 50.12

(56) References Cited

U.S. PATENT DOCUMENTS 4,542,269 A * 9/1985 Sakoda ..... 219/724

6,137,096 A * 10/2000 Seo ..... 219/722

FOREIGN PATENT DOCUMENTS

JP 2001-99429 * 4/2001

OTHER PUBLICATIONS

2000–337640; Dec. 8, 2000; Japan; Abstract Only.

2000–220839; Aug. 8, 2000; Japan; Abstract Only.

2000–028146; Jan. 25, 2000; Japan; Abstract Only.

* cited by examiner

*Primary Examiner*—Philip H. Leung
(74) *Attorney, Agent, or Firm*—Staas & Halsey LLP

(57) ABSTRACT

A microwave oven, is designed such that its switches accurately sense whether a door is open or not when opening or closing the door, thus preventing microwaves from leaking out. The microwave oven includes a hook unit, a hook locking unit, a locking step, and a sensing switch. The hook unit is mounted to the door functioning to open or close a cabinet. The hook locking unit is installed in the cabinet to engage with the hook unit. The locking step is provided in the hook locking unit to catch the hook unit when the hook unit enters the hook locking unit. The sensing switch is installed in the hook locking unit to sense whether the hook unit enters the hook locking unit. A screw holding unit is provided on a predetermined portion of the locking step to hold a setscrew which functions to mount the hook locking unit to the cabinet.

13 Claims, 5 Drawing Sheets

MICROWAVE OVEN WITH MICROWAVE LEAK CONTROL

CROSS-REFERENCE TO RELATED APPLICATIONS

This application claims the benefit of Korean Application No. 2002-55989, filed Sep. 14, 2002, in the Korean Industrial Property Office, the disclosure of which is incorporated herein by reference.

BACKGROUND OF THE INVENTION

1. Field of the Invention

The present invention relates, in general, to microwave ovens and, more particularly, to a microwave oven provided with a hook unit and a hook locking unit which are used to open or close a door.

2. Description of the Related Art

As is well known to those skilled in the art, a microwave oven is an appliance, which cooks food by microwaves irradiated from a magnetron into a cooking cavity, through a dielectric heating method. Thus, in order to prevent microwaves harmful to the human body from leaking out, the microwave oven is designed such that microwaves are not irradiated to the cooking cavity when the door is open, and microwaves are irradiated to the cooking cavity only when the door is closed. As such, in order to control the irradiation of microwaves, the conventional microwave oven is provided with a hook unit, a hook locking unit, and a safety device. In this case, the hook unit is mounted to the door. The hook locking unit is installed in a cabinet to engage with the hook unit. The safety device is provided in the hook locking unit, and senses whether the hook unit enters the hook locking unit or not when the door is open or closed, so as to control the power supply of the microwave oven, thus preventing microwaves from leaking out when the door is open.

As shown in FIGS. 1 and 2, the conventional microwave oven includes a hook unit 2 which is mounted to the door 1. The hook unit 2 includes a connecting member 3, an upper locking hook 4 and a lower locking hook 5. The connecting member 3 moves in a vertical direction in the door 1. The upper locking hook 4 is connected to the upper portion of the connecting member 3, and the lower locking hook 5 is connected to the lower portion of the connecting member 3. A spring 6 is installed to the lower portion of the connecting member 3 in the door 1, and downwardly pulls the hook unit 2 such that the upper and lower locking hooks 4 and 5 engage with a hook locking unit 7. The upper and lower locking hooks 4 and 5 are designed such that the bottom surfaces of their hooking parts are inclined to form inclined surfaces 4*a* and 5*a*, respectively, so the upper and lower locking hooks 4 and 5 easily disengage from the hook locking unit 7 by only pulling the door 1 forwards.

The hook locking unit 7 of the cabinet 8 is provided with upper and lower guide holes 9 and 10 which correspond to the upper and lower locking hooks 4 and 5, respectively. Upper and lower locking steps 11 and 12 are provided in the hook locking unit 7 to correspond to the upper and lower guide holes 9 and 10, and guide movements of the upper and lower locking hooks 4 and 5 to be caught by the locking steps 11 and 12, respectively. The upper and lower locking steps 11 and 12 inwardly extend from the lower edges of the guide holes 9 and 10 by predetermined lengths. Upper surfaces of the upper and lower locking steps 11 and 12 are inwardly and upwardly inclined to form guide surfaces 11*a* and 12*a*, respectively, thus guiding movements of the upper and lower locking hooks 4 and 5. The hook locking unit 7 is typically a plastic injection molded product, and is fixed, at a surface thereof, to a partition wall 8*a* by tightening setscrews 13. The partition wall 8*a* partitions the cabinet into a machine room and a cooking cavity.

Several switches 14, 15 and 16 are installed in the hook locking unit 7 to sense whether the door 1 is open or not in response to the entrance of the upper and lower locking hooks 4 and 5. The first sensing switch 14 is installed in the hook locking unit 7 at a position adjacent to the upper locking step 11, and is open or closed in response to the entrance of the upper locking hook 4. The second sensing switch 15 and the monitor switch 16 are installed in the hook locking unit 7 at positions adjacent to the lower locking step 12, and are open or closed in response to the entrance of the lower locking hook 5. In this case, the first and second sensing switches 14 and 15 sense whether the door 1 is open or not so as to control the supply of power. The monitor switch 16 functions to shut off the power supply of the microwave oven when the first and second sensing switches 14 and 15 malfunction.

When a user closes the door 1 of such a microwave oven, the upper and lower locking hooks 4 and 5 are caught by the locking steps 11 and 12 to keep the door 1 closed while the contact points of the switches 14, 15 and 16 are pressed by the locking hooks 4 and 5. Thus, power is applied to the microwave oven. At this time, microwaves are irradiated into the cooking cavity. Meanwhile, when a user pulls the door 1 to open it, the upper and lower locking hooks 4 and 5 disengage from the locking steps 11 and 12 while the switches 14, 15 and 16 are disconnected from the locking steps 11 and 12 so as to shut off the power supply. At this time, microwaves are not irradiated to the cooking cavity, thus preventing microwaves from leaking out.

However, the hook locking unit 7 of the conventional microwave oven is a plastic injection molded product, so there may occur plastic deformation of the hook locking unit 7. A screw holding unit 17 is provided at a position spaced apart from each of the locking steps 11 and 12 to hold the setscrew 13 which functions to mount the hook locking unit 7 to the cabinet. Thus, when a user pulls the door 1 to open it, the locking hooks 4 and 5 pull the locking steps 11 and 12, so there may occur slight deformation around the locking steps 11 and 12. Since such deformation makes the door 1 instantaneously and slightly open even when the contact points of the switches 14, 15 and 16 are pressed, there may occur the leakage of microwaves.

SUMMARY OF THE INVENTION

Accordingly, it is an aspect of the present invention to provide a microwave oven, which is designed to prevent a locking step from being deformed when a door is open or closed, so that switches accurately sense whether the door is open or not, thus preventing microwaves from leaking out.

Additional objects and advantages of the invention will be set forth in part in the description which follows and, in part, will be obvious from the description, or may be learned by practice of the invention.

Additional aspects and advantages of the invention will be set forth in part in the description which follows and, in part, will be obvious from the description, or may be learned by practice of the invention.

The foregoing and/or other aspects of the present invention are achieved by providing a microwave oven, including a hook unit mounted to a door functioning to open or close a cabinet, a hook locking unit installed in the cabinet to engage with the hook unit, a locking step provided in the hook locking unit to catch the hook unit when the hook unit enters the hook locking unit, and a sensing switch installed in the hook locking unit to sense whether the hook unit enters the hook locking unit or not, wherein a screw holding unit is provided on a predetermined portion of the locking step to hold a setscrew, the setscrew functioning to mount the hook locking unit to the cabinet.

According to the present invention, the screw holding unit is provided on an end of the locking step at which the hook unit is caught by the locking step.

Furthermore, the screw holding unit includes a cylindrical boss integrated with the locking step, and a threaded hole formed along a central axis of the cylindrical boss to engage with the setscrew.

BRIEF DESCRIPTION OF THE DRAWINGS

These and/or other aspects and advantages of the invention will become apparent and more readily appreciated from the following description of the preferred embodiment, taken in conjunction with the accompanying drawings of which.

DETAILED DESCRIPTION OF THE PREFERRED EMBODIMENT

Figure 1:
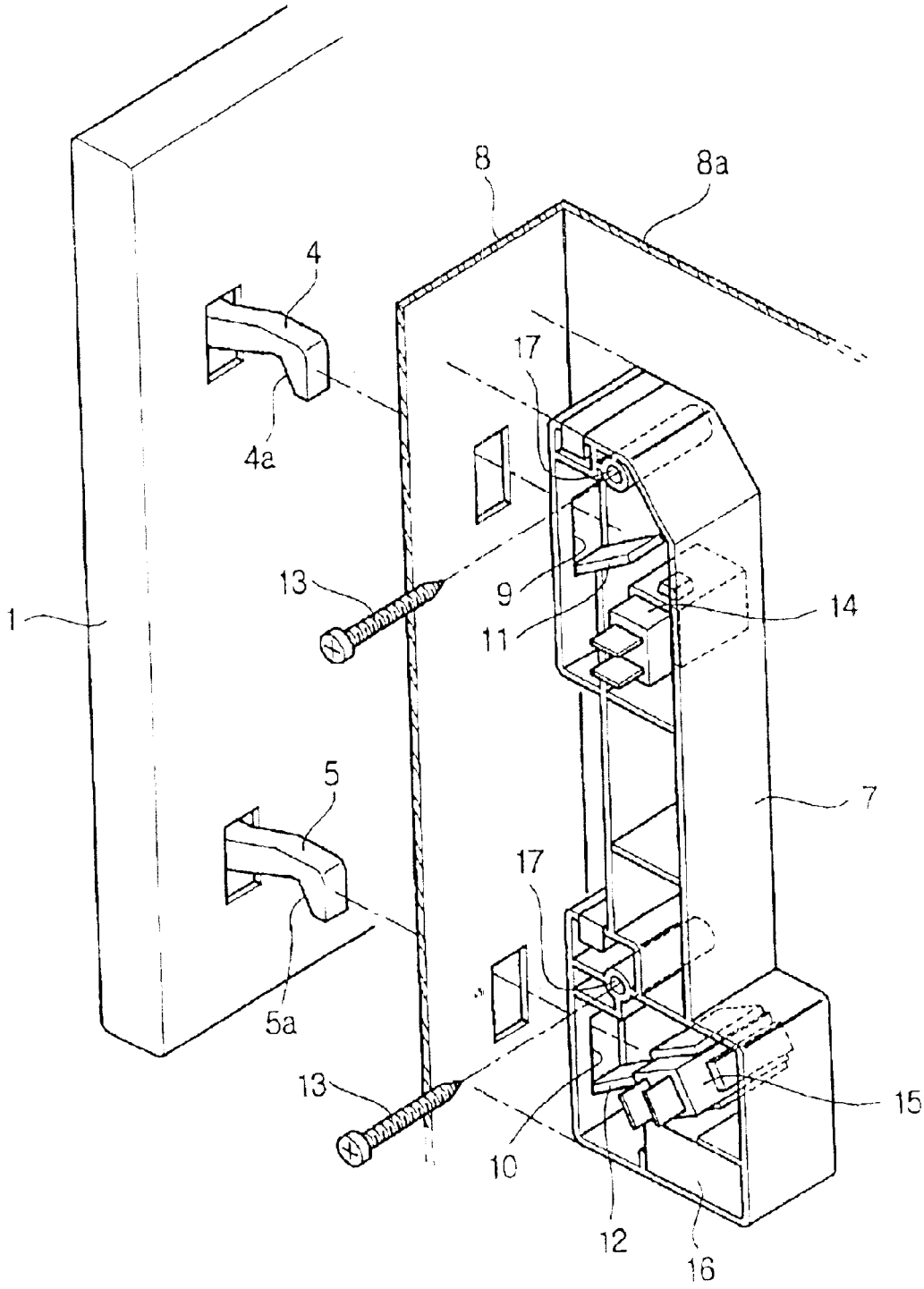
FIG. 1 (Prior Art)
FIG. 1 is a perspective view showing a hook unit and a hook locking unit included in a conventional microwave oven.
Figure 2:
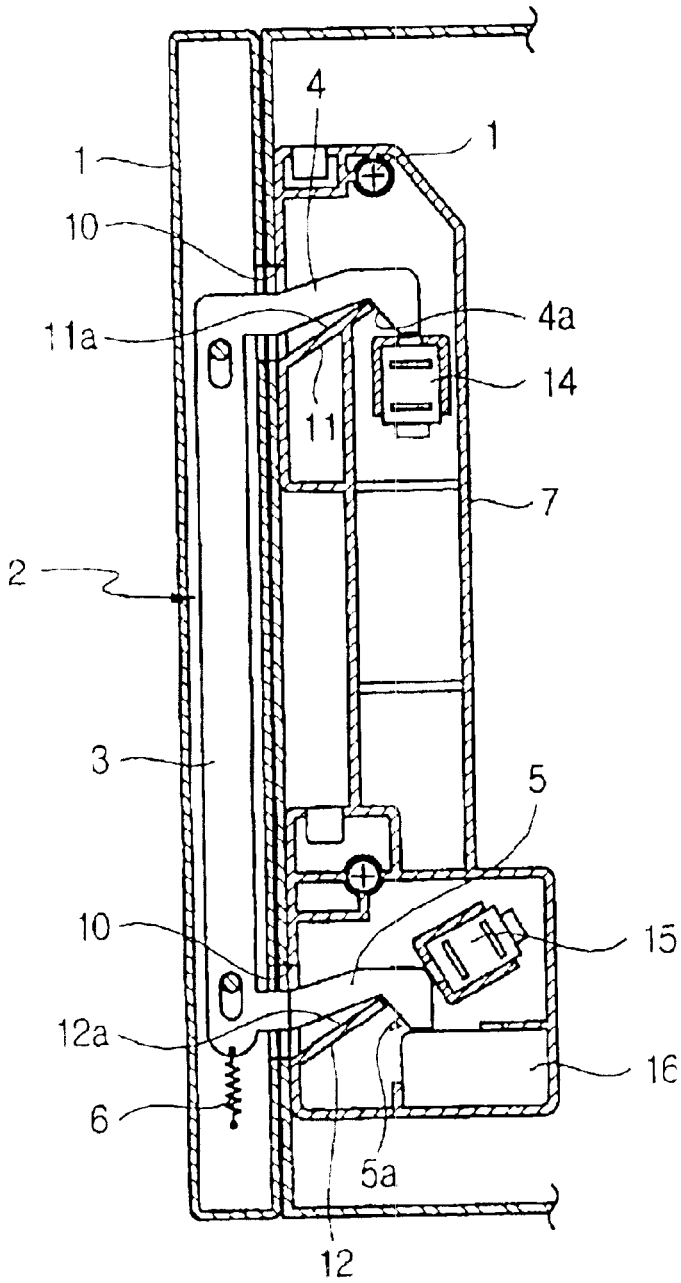
FIG. 2 (Prior Art)
FIG. 2 is a sectional view showing the hook unit and the hook locking unit included in the conventional microwave oven.

Reference will now be made in detail to the present preferred embodiment of the present invention, an example of which is illustrated in the accompanying drawings, wherein like reference numerals refer to like elements throughout.

Figure 3:
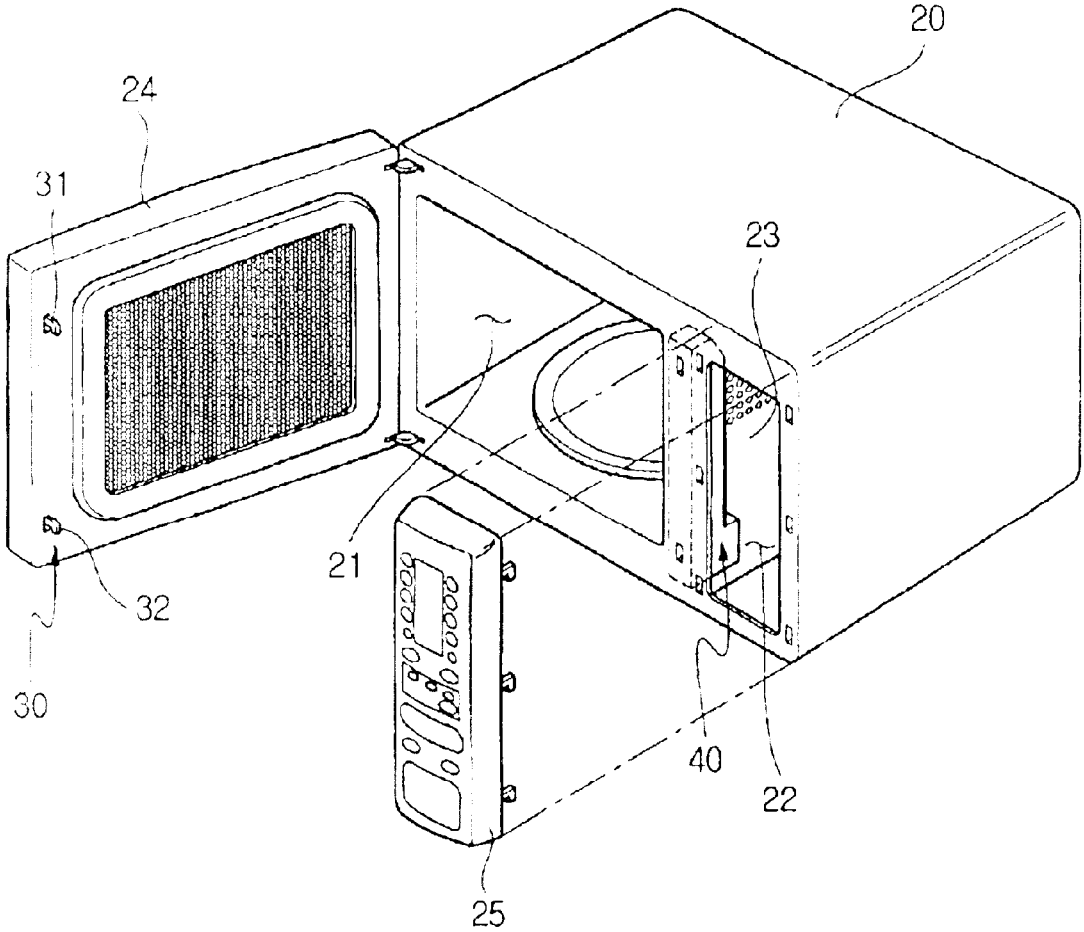
FIG. 3 is a perspective view of a microwave oven according to an embodiment of the present invention.

As shown in FIG. 3, the microwave oven of the present invention includes a cabinet 20. The cabinet 20 is partitioned into a cooking cavity 21 and a machine room 22 by a partition wall 23. The cooking cavity 21 is used for cooking food. The machine room 22 contains several electrical devices. A magnetron and a high-voltage transformer (not shown) are installed in the machine room 22. The magnetron irradiates microwaves into the cooking cavity 21. The high-voltage transformer applies high voltage to the magnetron.

A door 24 is rotatably hinged to the front of the cooking cavity 21 to open or close the cooking cavity 21. A control panel 25 is mounted to the front of the machine room 22, and is provided with several control buttons to control various functions of the microwave oven. A hook unit 30 is mounted to the door 24 to keep the door 24 closed when the door 24 is closed. A hook locking unit 40 is installed in the front portion of the cabinet 20 in such a way as to be placed between the cooking cavity 21 and the machine room 22, and engages with the hook unit 30 of the door 24.

Figure 4:
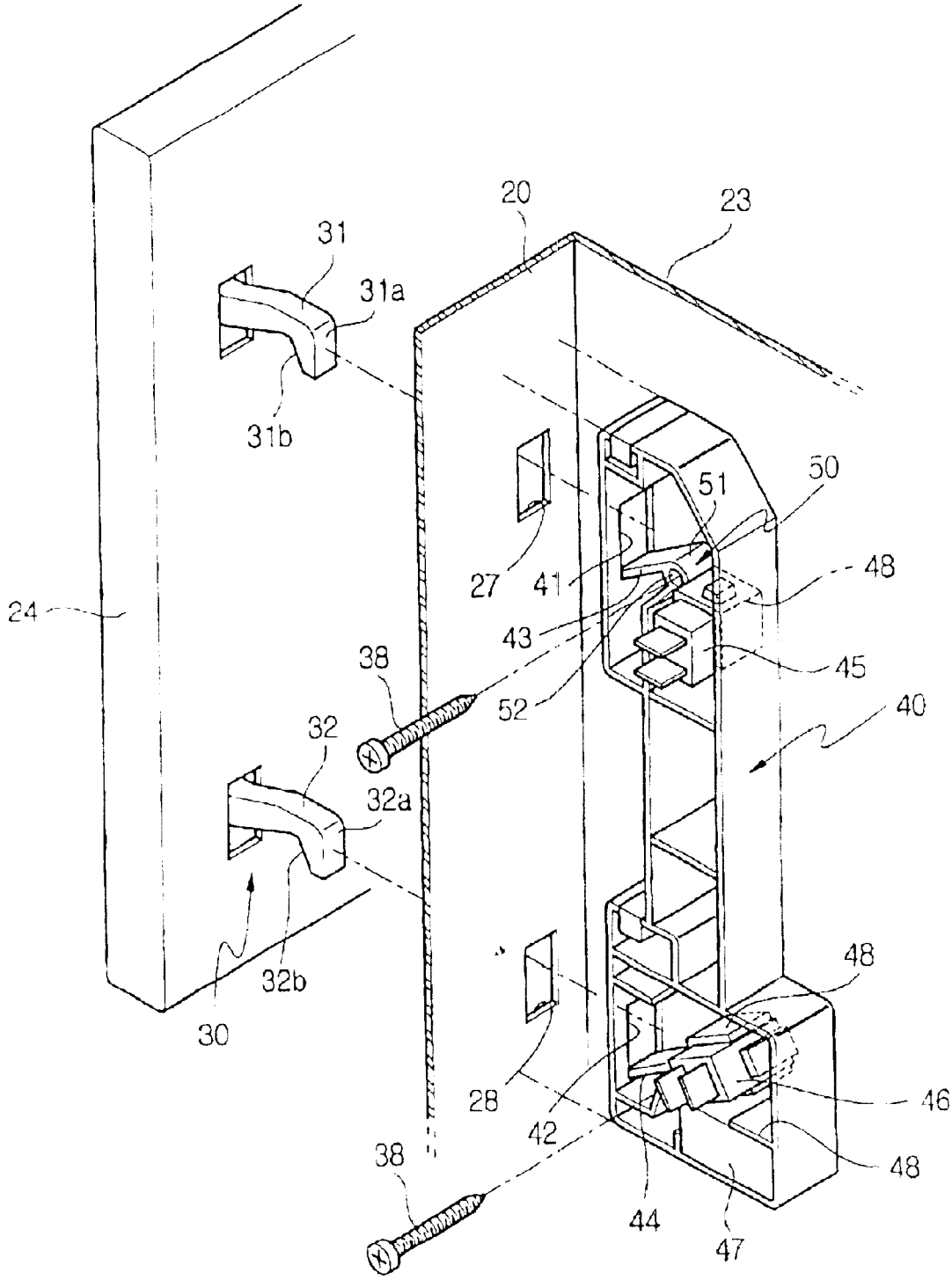
FIG. 4 is a perspective view showing a hook unit and a hook locking unit included in the microwave oven of FIG. 3.
Figure 5:
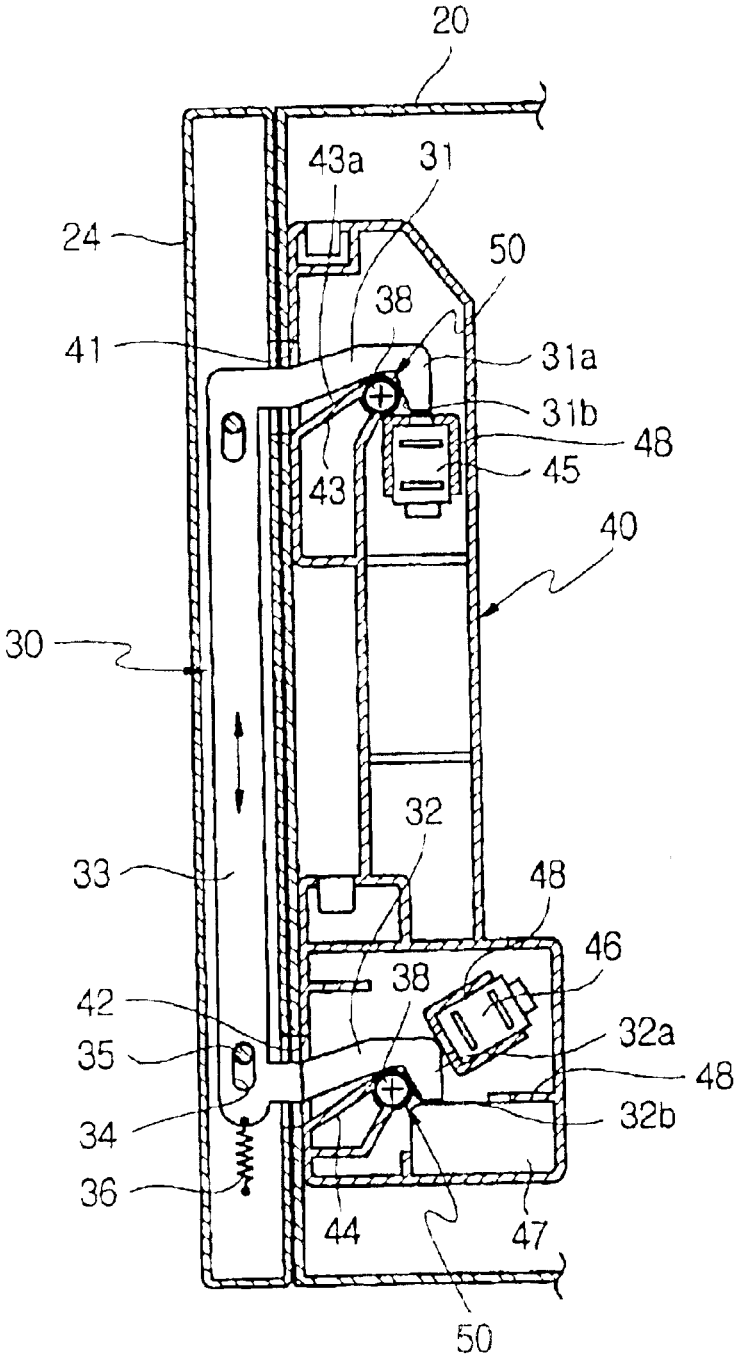
FIG. 5 is a sectional view showing the hook unit and the hook locking unit included in the microwave oven of FIG. 3.

As shown in FIGS. 4 and 5, the hook unit 30 includes upper and lower locking hooks 31 and 32 and a connecting member 33. The upper and lower locking hooks 31 and 32 are mounted to the upper and lower portions of the connecting member 33, respectively, in such a way as to inwardly project from the door 24. The connecting member 33 is installed in the door 24 in such a way as to move in a vertical direction. In this case, longitudinal holes 34 are formed on the connecting member 33 to allow the vertical movement of the connecting member 33. Pins 35 are inserted in the longitudinal holes 34 to support the connecting member 33. A spring 36 is connected to the lower end of the connecting member 33 to pull the connecting member 33 downwards such that the upper and lower locking hooks 31 and 32 enter the hook locking unit 40. Hooking parts 31*a* and 32*a* are formed by downwardly bending the ends of the upper and lower locking hooks 31 and 32, respectively, which inwardly project from the door 24. The bottom surfaces of the hooking parts 31*a* and 32*a* are inclined to form inclined surfaces 31*b* and 32*b*, thus allowing the upper and lower locking hooks 31 and 32 to easily disengage from the hook locking unit 40 by simply pulling the door 24 forwards.

The hook locking unit 40 is installed in the front portion of the cabinet 20 in such a way as to engage with the hook unit 30. In this case, the hook locking unit 40 is mounted to the cabinet 20 by tightening setscrews 38 to a surface of the partition wall 23 which partitions the cabinet 20 into the cooking cavity 21 and the machine room 22. The hook locking unit 40 of a hollow box shape is a plastic injection molded product and extends from the top to the bottom of the cabinet 20.

First upper and lower guide holes 41 and 42 are formed on the front surface of the hook locking unit 40 at positions corresponding to the upper and lower locking hooks 31 and 32 such that the upper and lower locking hooks 31 and 32 enter the hook locking unit 40. Second upper and lower guide holes 27 and 28 are formed on the front surface of the cabinet 20 at positions corresponding to the first upper and lower guide holes 41 and 42. Upper and lower locking steps 43 and 44 are provided inside the first guide holes 41 and 42 of the hook locking unit 40, respectively, to guide movements of the upper and lower locking hooks 31 and 32 and catch the locking hooks 31 and 32. The upper and lower locking steps 43 and 44 inwardly extend from the lower edges of the first guide holes 41 and 42 by predetermined lengths, and are inclined, at their upper surfaces, to form upwardly and inclined guide surfaces 43*a* and 44*a*. Such constructions of the locking steps 43 and 44 allow the upper and lower locking hooks 31 and 32, which are caught by the locking steps 43 and 44, to downwardly move after upwardly moving along the guide surfaces 43*a* and 44*a* by a predetermined range.

Several switches 45, 46 and 47 are installed in the hook locking unit 40 to sense whether the door 24 is open or not in response to the entrance of the upper and lower locking hooks 31 and 32, thus controlling the operation of the microwave oven. The first sensing switch 45 is installed in the hook locking unit 40 at a position adjacent to the upper locking step 43, and is open or closed in response to the entrance of the upper locking hook 31. The second sensing switch 46 and the monitor switch 47 are installed in the hook locking unit 40 at positions adjacent to the lower locking step 44, and are open or closed in response to the entrance of the lower locking hook 32. In this case, the first and second sensing switches 45 and 46 sense whether the door 24 is open or not so as to control the supply of power. The monitor switch 47 functions to shut off the power supply of the microwave oven when the first and second sensing switches 45 and 46 malfunction. The switches 45, 46 and 47 are fixed in the hook locking unit 40 by support ribs 48 in such a way that the contact points of the switches 45, 46 and 47 are in contact with the upper and lower locking hooks 31 and 32, respectively.

Screw holding units 50 are provided on ends of the upper and lower locking steps 43 and 44 to hold the setscrews 38 which function to mount the hook locking unit 40 to the partition wall 23 of the cabinet 20. Each screw holding unit 50 consists of a cylindrical boss 51 and a threaded hole 52 which is formed along the central axis of the cylindrical boss 51. The screw holding units 50 are integrated with the locking steps 43 and 44 through an injection molding method. Such a construction allows the setscrews 38 to firmly support the ends of the locking steps 43 and 44 at which the upper and lower locking hooks 31 and 32 are caught by the locking steps 43 and 44. Thus, although a considerable force is applied to the ends of the locking steps 43 and 44 when the upper and lower locking steps 31 and 32 are pulled by the opening of the door 24, the locking steps 43 and 44 and the portions around the locking steps 43 and 44 may be not deformed. Further, since there is no deformation of the locking steps 43 and 44 as well as the portions around them, the switches 45, 46 and 47 accurately sense whether the door 24 is open or not.

The operation of opening or closing the door 24 of the microwave oven constructed in this way will be described in the following.

When the door 24 is closed, the upper and lower locking hooks 31 and 32 are guided by the first upper and lower guide holes 41 and 42, respectively, to enter the hook locking unit 40. When the upper and lower locking hooks 31 and 32 enter the hook locking unit 40, the upper and lower locking hooks 31 and 32 upwardly move along the upper and lower locking steps 43 and 44, respectively, and then downwardly move by predetermined ranges by the elasticity of the spring 36 until being caught by the ends of the locking steps 43 and 44. At this time, the hooking parts 31*a* and 32*a* of the upper and lower locking hooks 31 and 32 press the contact points of the switches 45, 46 and 47 down. Thus, the first and second sensing switches 45 and 46 are on while the monitor switch 47 is off, so power is applied to the microwave oven, thus irradiating microwaves into the cooking cavity 21.

Meanwhile, when opening the door 24, the upper and lower locking hooks 31 and 32 are outwardly pulled, so the locking hooks 31 and 32 disengage from the locking steps 43 and 44, respectively, and simultaneously the switches 45, 46 and 47 are disconnected from the locking steps 43 and 44. Thus, the first and second sensing switches 45 and 46 are off while the monitor switch 47 is on, so power is shut off, thus stopping irradiation of microwaves into the cooking cavity 21. That is, there is no danger of the leakage of microwaves. In the case where the first and second sensing switches 45 and 46 malfunction, a circuit connected to the monitor switch 47 is shorted and power is shut off, so the microwave oven stops operating. There is still no danger of the leakage of the microwaves, in the same manner as described above.

Since the upper and lower locking hooks 31 and 32 are outwardly pulled to open the door 24, a considerable force may be instantaneously applied to the upper and lower locking steps 43 and 44. However, according to the present invention, the setscrews 38 which function to mount the hook locking unit 40 to the cabinet 20 firmly support the ends of the locking steps 43 and 44, so the locking steps 43 and 44 as well as the portions around the locking steps 43 and 44 are not deformed. Therefore, the switches 45, 46 and 47 accurately sense whether the door 24 is open or not, thus preventing microwaves from leaking out when the door 24 is open.

As apparent from the above description, the present invention provides a microwave oven, which is designed such that a screw holding unit is provided on the end of a locking step to hold a setscrew which functions to mount a hook locking unit to a cabinet, so there is no deformation of the locking step when opening or closing a door, thus allowing switches to accurately sense whether the door is open or not, therefore preventing the leakage of microwaves.

In another embodiment, the invention may include at least one support unit, adjacent to a hook locking unit, and each support unit may have at least one screw holding unit to hold at least one setscrew. Each setscrew functions to mount the hook locking unit to the cabinet. Where desired, the support units may be integrated with the screw holding units via injection molding.

Although a preferred embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A microwave oven having a cabinet with an opening and a door to close the opening, the microwave oven comprising:

at least one hook unit mounted to the door functioning to open or close the opening;

at least one hook locking unit installed in the cabinet to engage with the hook unit wherein each hook locking unit includes:

at least one locking step to catch the hook unit when the hook unit enters the hook locking unit;

a sensing switch to sense whether the hook unit enters the hook locking unit, and at least one screw holding unit is positioned on a predetermined portion of each locking step to hold at least one setscrew, each setscrew functioning to mount the hook locking unit to the cabinet, wherein each screw holding unit is positioned on an end of a corresponding one of the at least one locking step at which a corresponding hook unit is caught by the corresponding at least one locking step.

2. The microwave oven according to claim 1, wherein said screw holding unit comprises:

a cylindrical boss integrated with the locking step; and a threaded hole formed along a central axis of said cylindrical boss to engage with said setscrew.

3. The microwave oven according to claim 1, wherein each locking step is integrated with a corresponding screw holding unit via injection molding.

4. A microwave oven comprising:

a cabinet partitioned into a cooking cavity for cooking food and a machine room for housing electrical devices for activating and controlling microwaves into the cooking cavity, and a hook locking unit with at least one substantially undeformable locking step installed between the cooking cavity and the machine room on a front portion of the cabinet, wherein a sensor proximate to the hook locking unit controls microwave operation; and a door rotatably hinged to the front of the cooking cavity, the door having a hooking unit mounted thereon, wherein the at least one substantially undeformable locking step includes a screw holding unit on an end of the locking step at which said hook unit is caught by the locking step.

5. The microwave oven of claim 4 wherein the at least one substantially undeformable locking step includes a screw holding unit comprising:

a cylindrical boss integrated with the locking step; and a threaded hole formed along a central axis of said cylindrical boss to engage with a setscrew.

6. A microwave oven comprising:

a hook locking unit with at least one substantially undeformable locking step installed on a front portion of a cabinet wherein the cabinet is partitioned into a cooking cavity and a machine room, the substantially undeformable locking step is installed therebetween and a sensor proximate to the locking step controls microwave operation; and a door rotatably hinged to the front portion of the cabinet proximate to the cooking cavity, the door having a hooking unit mounted thereon and the hooking unit having at least one hook for engaging the locking step, wherein the at least one substantially undeformable locking step includes a screw holding unit on an end of the locking step at which said hook unit is caught by the locking step.

7. The microwave oven of claim 6 wherein the at least one substantially undeformable locking step includes a screw holding unit comprising:

a cylindrical boss integrated with the locking step; and a threaded hole formed along a central axis of said cylindrical boss to engage with a setscrew.

8. A hooking assembly for minimizing leakage of microwaves from a cabinet, comprising:

a hook locking unit having at least one substantially undeformable locking step installed on a front portion of the cabinet wherein microwaves are generated and having a sensor proximate to the locking step for controlling microwave operation; and a hooking unit mounted on a door of the cabinet wherein the hooking unit has at least one hook for engaging the at least one substantially undeformable locking step, wherein the at least one substantially undeformable locking step includes a screw holding unit on an end of the locking step at which said hook unit is caught by the locking step.

9. The hooking assembly as claimed in claim 8 wherein the substantially undeformable locking step includes a screw holding unit comprising:

a cylindrical boss integrated with the substantially undeformable locking step; and a threaded hole formed along a central axis of said cylindrical boss to engage with a setscrew.

10. A microwave oven having a locking assembly having a substantially undeformable locking assembly for minimizing leakage of microwaves, the locking assembly comprising:

a hook locking unit having at least one substantially undeformable locking step installed on a front portion of the microwave oven and at least one sensing switch proximate to the locking step for sensing whether a hooking unit enters the hook locking unit; and the hooking unit mounted on a door of the microwave oven wherein the hooking unit has at least one hook for engaging the at least one substantially undeformable locking step, wherein the at least one substantially undeformable locking step includes a screw holding unit on an end of the locking step at which said hook unit is caught by the locking step.

11. The microwave oven as claimed in claim 10 wherein the substantially undeformable locking step includes a screw holding unit comprising:

a cylindrical boss integrated with the substantially undeformable locking step; and a threaded hole formed along a central axis of said cylindrical boss to engage with a setscrew.

12. A microwave oven having a cabinet with an opening and a door to close the opening, the microwave oven comprising:

at least one hook unit mounted to the door functioning to open or close the opening;

at least one hook locking unit installed in the cabinet to engage with the hook unit, wherein each hook locking unit includes:

at least one locking step to catch the hook unit when the hook unit enters the hook locking unit;

a sensing switch to sense whether the hook unit enters the hook locking unit, and at least one support unit, adjacent to the hook locking unit, to mount the hook locking unit to the cabinet, wherein the at least one locking step includes a screw holding unit on an end of the locking step at which said hook unit is caught by the locking step.

13. The microwave oven according to claim 12, wherein said support unit comprises a screw holding unit which is integral with the corresponding locking step via injection molding to hold a corresponding set screw.

* * * * *